US011649609B2

(12) United States Patent
Sullivan, Jr. et al.

(10) Patent No.: US 11,649,609 B2
(45) Date of Patent: May 16, 2023

(54) HYDRAULIC SYSTEM AND METHODS FOR AN EARTHMOVING MACHINE

(71) Applicant: Caterpillar Inc., Peoria, IL (US)

(72) Inventors: Patrick W. Sullivan, Jr., Plainfield, IL (US); Ryan R. Stoffel, Oswego, IL (US); Beau D. Kuipers, Morris, IL (US); Andrew N. Schifferer, Batavia, IL (US); Royce E. Leaders, Oswego, IL (US); Fuaad Sayeed, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 235 days.

(21) Appl. No.: 17/093,120

(22) Filed: Nov. 9, 2020

(65) Prior Publication Data

US 2022/0145589 A1 May 12, 2022

(51) Int. Cl.

| | |
|---|---|
| ***E02F 9/22*** | (2006.01) |
| ***E02F 3/43*** | (2006.01) |
| ***E02F 3/42*** | (2006.01) |
| ***F15B 13/02*** | (2006.01) |
| ***E02F 3/28*** | (2006.01) |

(52) U.S. Cl.

CPC ..... *E02F 9/2228* (2013.01); *E02F 3/283* (2013.01); *E02F 3/422* (2013.01); *E02F 3/431* (2013.01); *E02F 9/2203* (2013.01); *E02F 9/2217* (2013.01); *E02F 9/2267* (2013.01); *F15B 13/024* (2013.01); *E02F 9/2285* (2013.01); *E02F 9/2296* (2013.01)

(58) Field of Classification Search

CPC ..... E02F 9/2246; E02F 9/2228; F15B 2211/20523; F02D 29/04

See application file for complete search history.

(56) References Cited

U.S. PATENT DOCUMENTS

| | | | | |
|---|---|---|---|---|
| 6,397,655 | B1 | 6/2002 | Stephenson | |
| 6,895,798 | B2 | 5/2005 | Sosnowski | |
| 7,467,033 | B2 | 12/2008 | Miller et al. | |
| 7,474,948 | B2 | 1/2009 | Sandstrom | |
| 7,997,117 | B2 | 8/2011 | Zhang et al. | |
| 9,435,105 | B2 | 9/2016 | Fleischmann et al. | |
| 2013/0227933 | A1 * | 9/2013 | O'Neil | F02D 41/08 60/274 |
| 2014/0129035 | A1 | 5/2014 | Marquette et al. | |
| 2016/0108786 | A1 * | 4/2016 | Narayanan | F01N 9/00 60/286 |

FOREIGN PATENT DOCUMENTS

| | | | | |
|---|---|---|---|---|
| IN | 1482/CHE/2013 | A | 1/2016 | |
| JP | 2012255434 | A * | 12/2012 | |
| KR | 20140084401 | A * | 7/2014 | |
| KR | 20140121506 | A * | 10/2014 | |
| WO | WO-2012122756 | A1 * | 9/2012 | E02F 9/2228 |

* cited by examiner

*Primary Examiner* — Thomas E Lazo

(57) ABSTRACT

A hydraulic system for a machine includes an implement pump, a valve, and an implement valve subsystem. The implement pump includes a load sensing control, and the valve controls the flow of hydraulic fluid to the implement pump. The implement valve subsystem includes one or more implement control subsystems to control movement of an implement. The valve is an electrohydraulic proportional relief valve and includes a solenoid configured to adjust the pressure of hydraulic fluid delivered to the implement pump proportionally to a current delivered through the solenoid.

16 Claims, 5 Drawing Sheets

HYDRAULIC SYSTEM AND METHODS FOR AN EARTHMOVING MACHINE

TECHNICAL FIELD

The present disclosure relates generally to hydraulic systems and methods, and more particularly, to a hydraulic system and methods for an earthmoving machine.

BACKGROUND

Earthmoving machines, such as wheel loaders, motor graders, excavators, and dozers, are commonly used in material moving applications, including mining, road maintenance, surface contouring, etc. To effectively accomplish tasks associated with these applications, the vehicles often include hydraulic systems to provide functionality and/or control various aspects of the machines, such as hydraulically-powered articulation joints, hydraulically-powered traction devices, and hydraulically powered implements, such as buckets, shovels, and blades. A prime mover, for example a diesel, gasoline, or gaseous fuel-powered internal combustion engine, drives dedicated steering and implement pumps that provide hydraulic power to the steering components and the implements.

These machines often include exhaust gas recirculation ("EGR"), in which emissions from the engine may be reduced by recirculating a portion of the engine's exhaust gas back to the engine cylinders. EGR may reduce harmful emissions from the machine by reducing the peak combustion temperature of the engine. Many diesel engines are coupled to an after-treatment system, which includes a diesel oxidation catalyst ("DOC"). The DOC may also be used to reduce emissions by controlling diesel particulate emissions and/or as an auxiliary catalyst for a filter in the after-treatment system, for example, a diesel particulate filter ("DPF"). Nevertheless, such systems often develop an accumulation of particulate matter (e.g., soot) on the filter, for example, due to low exhaust temperatures. The accumulation of particulate matter may result in increased back pressure on the prime mover. Accordingly, the drive system requires periodic regeneration, for example, to burn off particulate matter that has accumulated in the drive system. The regeneration may promote oxidation (e.g., burning off) of the particulate matter on the filter with heat from engine exhaust. However, under certain operating conditions (e.g., when environmental temperatures are low, when torque on the engine is low, etc.), an exhaust temperature of the engine may not be hot enough to provide regeneration. As a result, the machine may encounter difficulties in performing the regeneration in cold ambient temperature conditions (e.g., below freezing) and/or when there is a low load on the engine.

U.S. Pat. No. 7,467,033, issued to Miller et al. on Dec. 16, 2008 ("the '033 patent), describes a method of controlling an engine to maintain a calibrated minimum load for the engine. The method of the '033 patent involves a minimum engine torque adder that is calibrate as a torque ramp rate to adjust the allowable torque limit that is added to the engine torque if the measured engine load is near the calibrated minimum engine load for a given engine speed. The method of the '033 patent may help to maintain engine fuel combustion stability and avoid undesirable engine exhaust gas temperatures during prolonged engine operation at low load. While the control method of the '033 patent may help maintain a calibrated minimum load on an engine, the added load on the engine via the torque added may not be desirable under certain conditions.

The systems and methods of the present disclosure may address or solve one or more of the problems set forth above and/or other problems in the art. The scope of the current disclosure, however, is defined by the attached claims, and not by the ability to solve any specific problem.

SUMMARY

In one aspect, a hydraulic system for a machine may include an implement pump, a valve, and an implement valve subsystem. The implement pump may include a load sensing control, and the valve may control the flow of hydraulic fluid to the implement pump. The implement valve subsystem may include one or more implement control subsystems to control movement of an implement. The valve may be an electrohydraulic proportional relief valve and may include a solenoid configured to adjust the pressure of hydraulic fluid delivered to the implement pump proportionally to a current delivered through the solenoid.

In another aspect, a method of operating a hydraulic system for a machine may include, in response to a regeneration cycle for a particulate filter in an after-treatment system for an engine, detecting one or more of an ambient temperature, a temperature of the exhaust of the engine, or a load demand on the engine. The method may also include, in response to one or more of the ambient temperature, the temperature of the exhaust of the engine, or the load demand on the engine being below respective threshold values, delivering current through a solenoid of an electrohydraulic valve. The electrohydraulic valve may control a flow of hydraulic fluid to an implement pump, and the current through the solenoid may cause the electrohydraulic valve to open and deliver hydraulic fluid to the implement pump to upstroke the implement pump. The implement pump may control an implement and may include a load sensing control configured to increase the pressure demand on the implement pump in response to the delivery of hydraulic fluid. The increase pressure demand on the implement pump may be configured to increase the power demand on the engine.

In yet another aspect, an earthmoving machine may include an engine, an implement, and a hydraulic system. The hydraulic system may include an implement pump and an electrohydraulic valve. The implement pump may be powered by the engine and may be configured to drive the implement, and the implement pump may include a load sensing control. The electrohydraulic valve may control the flow of hydraulic fluid to the load sensing control of the implement pump. The electrohydraulic valve may include a solenoid configured to adjust the pressure of hydraulic fluid through the electrohydraulic valve proportionally to a current delivered through the solenoid.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," "approximately," and "proximate" are used to indicate a possible variation of ±10% in a stated value.

Figure 1:
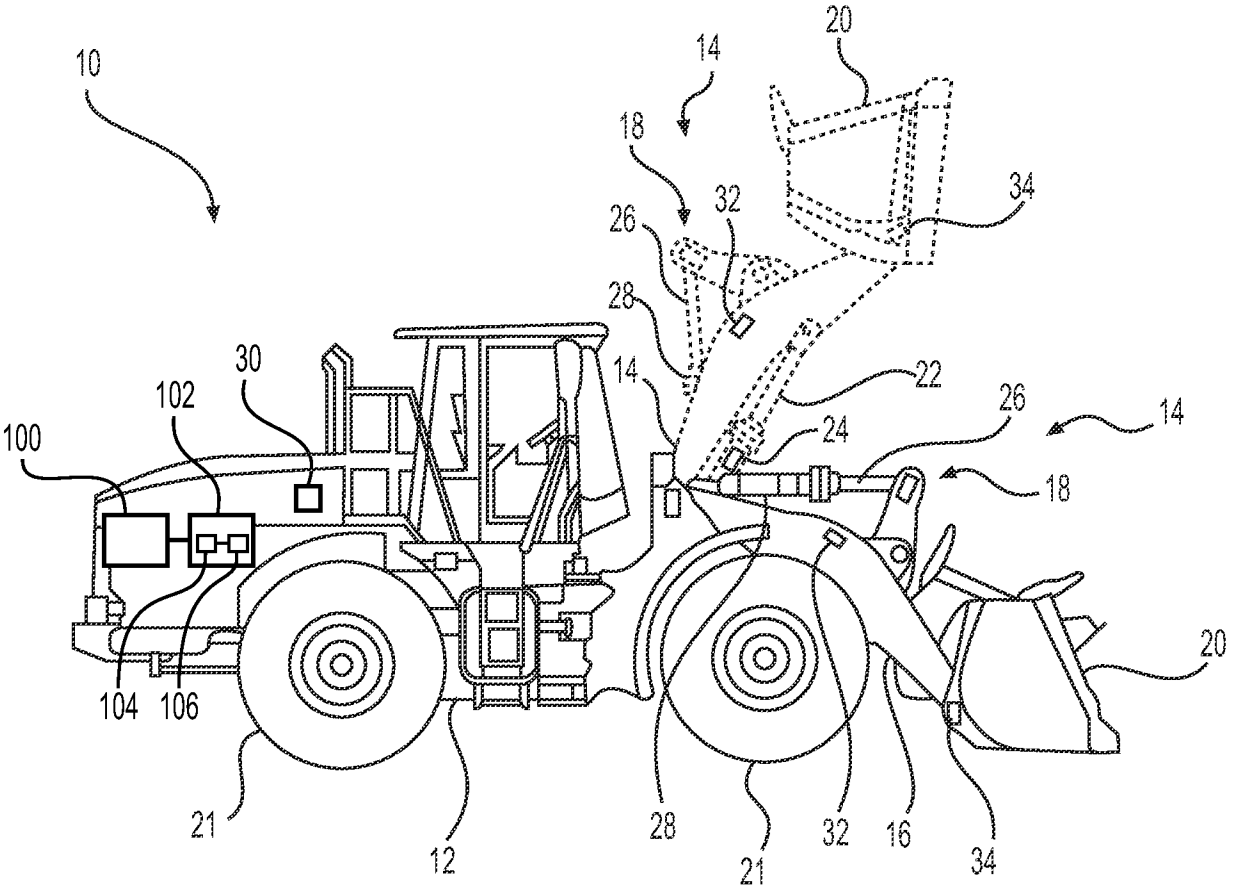
FIG. 1 is an illustration of an exemplary machine according to aspects of the disclosure.

FIG. 1 depicts an exemplary machine, for example, a wheel loader 10. Although the machine depicted in FIG. 1 is a wheel loader, wheel loader 10 may be any of the types of machines described above. Wheel loader 10 includes a machine body 12, which may include an operator station, an engine housing, and a prime mover or an engine 100. Engine 100 may be a diesel engine, and may be coupled to an after-treatment system 102. For example, an exhaust line from engine 100 may be coupled to after-treatment system 102. After-treatment system 102 may include a diesel oxidation catalyst ("DOC") 104 and a particulate filter 106 (e.g., a diesel particular filter or a DPF). Wheel loader 10 may also include an implement assembly 14. Implement assembly 14 may include an arm 16, a linkage 18, and a bucket 20. Bucket 20 may be coupled to an end of arm 16. Although not shown, bucket 20 may also be a different work implement, such as a fork, grapple, etc., and, in some aspects, the work implement may be interchangeable. Linkage 18 may have one or more degrees of freedom. Wheel loader 10 may include ground surface engaging devices, such as wheels 21 that support machine body 12 and are powered by engine 100. Although a wheeled machine is shown and described, one skilled in the art will appreciate that other machines, including track-type machines, may also be utilized. FIG. 1 also shows wheel loader 10 with a first, lowered configuration (solid lines) of implement assembly 14 and with a second, raised configuration (dashed lines) of implement assembly 14.

In the example of the machine being wheel loader 12, movement (e.g., lift) of bucket 20 and/or arm 16 may be powered and controlled by a lift actuator 22. Lift actuator 22 may include, for example, a hydraulic fluid cylinder actuator or any other type of actuator, as would be apparent to one skilled in the art. One or more lift pressure sensors 24 may be configured to measure forces within the actuator 22, or on another component of lift actuator 22, and may be force sensors. The tilt of bucket 16 may be powered and controlled by a tilt actuator 26. Tilt actuator 26 may include, for example, a hydraulic fluid cylinder actuator or any other type of actuator, as would be apparent to one skilled in the art. One or more tilt pressure sensors 28 may be configured to measure forces within tilt actuator 26, or on another component of tilt actuator 26, and may be force sensors. For example, as shown in FIG. 1, lift pressure sensors 24 and tilt pressure sensors 28 may be disposed in/on a head end and a rod end of lift actuator 22 and tilt actuator 26, respectively. Alternatively or additionally, lift pressure sensors 24 and tilt pressure sensors 28 may be disposed in other locations relative to an actuator, such as within a hydraulic circuit associated with an actuator (e.g., one or more of control subsystems 208*a*-208*c*, FIG. 2). Forces acting on lift and/or tilt cylinder 22, 26 may include a head-end pressure and/or a rod-end pressure on each side of a piston of the actuator. Lift pressure sensors 24 and tilt pressure sensors 28 may be configured to measure one or both of head-end and rod-end pressures of the lift and tilt cylinders, respectively. Alternatively, lift pressure sensors 24 and tilt pressure sensors 28 may be configured to measure a net force acting on a lift or tilt cylinder, respectively. Lift pressure sensors 24 and tilt pressure sensors 28 may detect pressure of fluid within their respective actuator. Force or pressure information may also be derived from other sources, including other sensors.

Additionally, wheel loader 10 may include one or more additional sensors, for example, an arm position sensor 32 and a bucket position sensor 34. Arm position sensor 32 may gather data indicative of a position of arm 14, including for example, an angle, a height or an extension of arm 14. Bucket position sensor 34 may gather data indicative of a position of bucket 16, including, for example, a height, lateral location, and/or tilt of bucket 16. Although not shown, wheel loader 10 may include one or more additional sensors, inertial measurement units, etc.

The sensors mentioned herein may be coupled, for example, via a wired or wireless connection, to a controller 30. In these aspects, controller 30 may be in communication with one or more features of wheel loader 10 and receive inputs from and send outputs to, for example, one or more user interfaces in the cab or remote from wheel loader 10. For example, wheel loader 10 may include electrohydraulic and/or hydro mechanical hydraulic systems, and controller 30 may control one or more electrical switches or valves in order to control one or more hydraulic cylinders, actuators, or electrical elements in order to operate wheel loader 10. It is understood that controller 30 may include one or more controllers each associated with one or more components or systems of wheel loader 10. For example, controller 30 may be in communication with a valve 204 and/or an implement pump 206 (FIG. 2) for controlling aspects of valve 204 and/or implement pump 206, which may control aspects of engine 100 (e.g., a load command, a temperature of the output exhaust, etc.), as further detailed below.

Engine 100 may be configured to generate and transmit power to wheels 21, for example, via a transmission (not shown). Engine 100 may include an internal combustion engine that produces mechanical and/or electrical power output. For example, engine 100 may be a four-stroke diesel engine. In this aspect, engine 100 may be coupled to after-treatment system 102, which may include diesel oxidation catalyst ("DOC") 104 and particulate filter 106. Engine 100 may include one or more subsystems, for example, a fuel system, an air induction system, an exhaust system (coupled to after-treatment system 102), a lubrication system, a cooling system, and/or the like. Engine 100 may be configured to produce a torque output directed to a transmission and/or to other parasitic loads (e.g., to hydraulic systems (i.e., implement pump 206), electrical systems, cooling systems, etc.) through a range of speeds.

As mentioned, engine 100 may be coupled to after-treatment system 102, which may include DOC 104 and particular filter 106. DOC 104 may be the first component (i.e., directly downstream from engine 100) of after-treatment system 102. For example, DOC 104 may receive an exhaust flow from engine 100 at an inlet of DOC 104. DOC 104 may be a flow through filter that includes one or more oxidation devices. The one or more oxidation devices may include one or more precious metals, and may help to initiate an oxidation of hydrocarbons, carbon monoxide, unburned fuel and oil, etc. Particulate filter 106 may be downstream of DOC in after-treatment system 102. Particulate filter 106 may be a wall-flow filter that helps to trap or otherwise collect soot or other particulate material that was not oxidized by DOC 104. Particulate filter 106 may be heated by the exhaust flow from engine 100, thereby thermally aging or oxidizing the particulate matter deposited in particulate filter 106 when the exhaust flow is of a sufficient temperature. In some instances, for example, when environmental temperatures are low, when torque on the engine is low, etc., the heat from the exhaust flow from engine 100 may not be hot enough to oxidize the particulate material collected by particulate filter 106. In these instances, it may be necessary for wheel loader 10 to perform a regeneration cycle to increase the load command on engine 100 such that engine 100 outputs an exhaust flow that is hot enough to oxidize the particulate material (e.g., approximately 600 degrees Celsius). In some examples, although not shown, after-treatment system 102 may include a selective catalytic reducer (SCR), for example, downstream of particulate filter 106.

Figure 2:
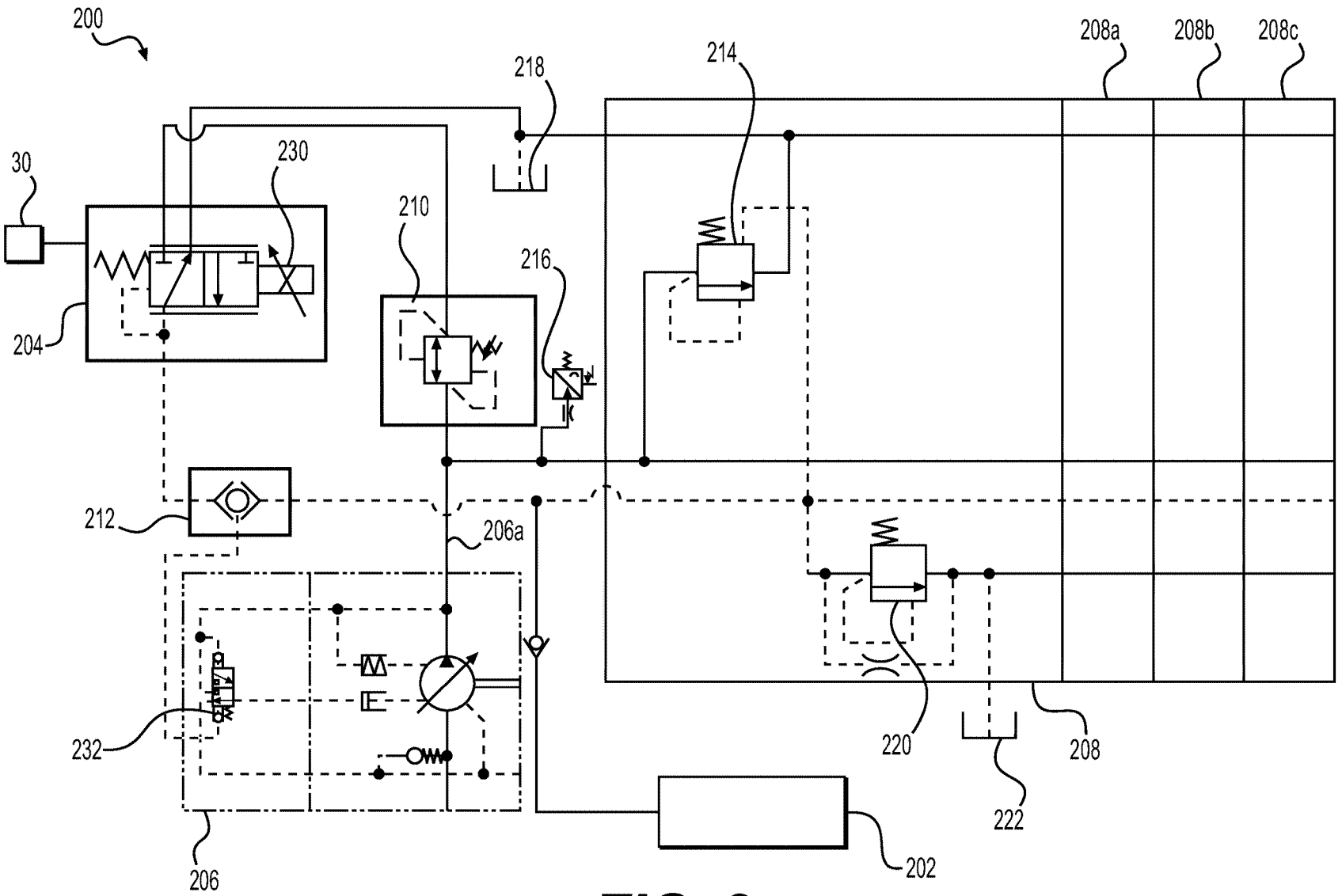
FIG. 2 is a schematic of an exemplary hydraulic system of the machine of FIG. 1.

FIG. 2 is a schematic illustration of a portion of a hydraulic system 200 that may control the position and/or movement of an implement, for example, bucket 16. As shown in FIG. 2, hydraulic system 200 includes a pilot pressure valve 202, a valve 204, an implement pump 206, and an implement valve subsystem 208. Hydraulic system 200 may include a relief valve 210, for example between portions of valve 204 and implement pump 206. For example, relief valve 210 may be a proportional relief valve, which may allow for the control of the pressure in the hydraulic line connecting a discharge line 206*a* of implement pump 206 to valve 204. Hydraulic system 200 may also include a resolver 212, for example, between portions of valve 204, implement pump 206, and implement valve subsystem 208. Resolver 212 may include a hydraulic logic element and may help to maintain consistent pressures between portions, for example, pilot pressure portions, of valve 204, implement pump 206, and implement valve subsystem 208 by receiving two pressures and outputting the higher of the two pressures. Hydraulic system 200 may also include a margin relief valve 214, which may be positioned within implement valve subsystem 208, and may relieve pressure from implement valve subsystem 208 when the hydraulic fluid exceeds a predetermined pressure. Margin relief valve 214 may help to create resistance to the flow of hydraulic fluid driven by implement pump 206. Furthermore, hydraulic system 200 may include one or more pressure sensors 216, which may detect the pressure of the hydraulic fluid at one or more locations in hydraulic system 200. Moreover, hydraulic system 200 may include one or more outlets 218, for example, to return hydraulic fluid to a reservoir tank. One or more components of hydraulic system 200, for example, one or more of pilot pressure valve 202, implement pump 206, implement valve subsystem 208, relief valve 210, pressure sensor 216, etc., may be in communication (e.g., via a wired or wireless connection) with controller 30.

Pilot pressure valve 202 may be any suitable pressure valve, such as, for example, a relief valve, a piston valve, a guided-piston relief valve, a differential-piston relief valve, etc. Pilot pressure valve 202 may provide a release of hydraulic fluid when the internal pressure of hydraulic system 200 exceeds a pressure of approximately 2500 kPa to approximately 4000 kPa, for example, approximately 3800 kPa. Additionally, pilot pressure valve 202 may be coupled to one or more reservoirs (not shown) of hydraulic fluid. In one aspect, pilot pressure valve 202 may be configured to ensure an adjustable pilot pressure for hydraulic system 200, for example, controlled by controller 30.

As shown in FIG. 2, valve 204 is a directional valve and includes a solenoid 230. For example, wheel loader 10 may be an electrohydraulic machine, and valve 204 may be an electrohydraulic proportional valve. Valve 204 may be biased toward a closed configuration, but valve 204 may open when current is delivered through solenoid 230. Valve 204 may be a proportional valve and solenoid 230 may be a proportional solenoid, for example, such that solenoid 230 adjusts and/or regulates flow of hydraulic fluid through valve 204 based on an intensity of an electrical signal (i.e., current), for example, from controller 30. Valve 204 may be a control valve associated with pump 206. Additionally, as shown, valve 204 may be upstream of implement pump 206, for example, such that output fluid from valve 204 may be delivered to pump 206, for example, through resolver 212 when the pressure of the hydraulic fluid from valve 204 exceeds the pressure of hydraulic fluid on the opposing side of resolver 212.

Implement pump 206 may be a hydraulic pump and may include an integrated load sensing control 232. As mentioned, implement pump 206 may be powered by engine 100. Additionally, implement pump 206 may pressurize hydraulic fluid based on a pressure, volume, flow, etc. of hydraulic fluid received at load sensing control 232. In this aspect, the pressure command on implement pump 206 may be proportional to the current through solenoid 230, for example, through the relationship between the current through solenoid 230 and the flow of hydraulic fluid through valve 204. For example, as discussed below, over one or more ranges, the pressure command on implement pump 206 may be substantially linearly correlated to the current through solenoid 230. In these aspects, valve 204 and solenoid 230 may be controlled to add load on engine 100, for example, during a regeneration cycle. Additionally, over the one or more ranges, the power command on engine 100 may be substantially linearly correlated to the current through solenoid 230.

Implement valve subsystem 208 may include one or more subsystems, for example, to control the position of bucket 20. The one or more subsystems may be controlled based on the relative pressures on respective portions of the subsystems. For example, implement valve subsystem 208 may include a rack/dump control subsystem 208*a*, a lift/lower/float control subsystem 208*b*, and one or more auxiliary control subsystems 208*c*. Additionally, implement valve subsystem 208 may include an implement valve relief valve 220, which may be connected to an outlet 222, for example, to return hydraulic fluid to the reservoir.

Figure 3:
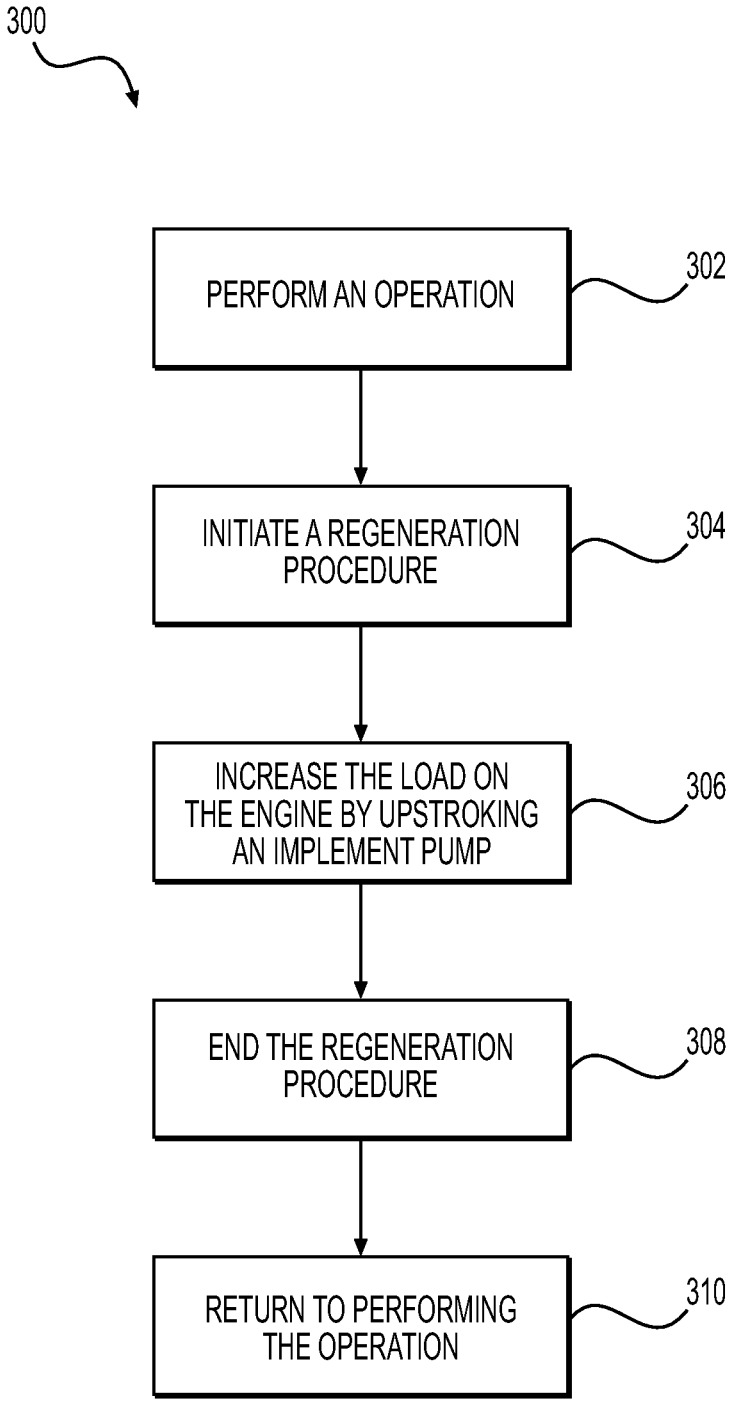
FIG. 3 provides a flow chart depicting an exemplary method for controlling the hydraulic system of the machine.

FIG. 3 is a flow chart depicting an exemplary method 300 for controlling hydraulic system 200. In an optional initial step 302, wheel loader 10 may perform an operation, for example, moving material from one location to another.

Next, in a step 304, wheel loader 10 may initiate a regeneration cycle or procedure. For example, one or more sensors coupled to controller 30 may detect a build up of particulate material on particulate filter 106 in after-treatment system 102. Alternatively, the regeneration procedure may be initiated after a predetermined amount of operating time for wheel loader 10 since the previous regeneration procedure. As discussed above, the regeneration procedure includes increasing the load command on engine 100 such that the exhaust temperature is increased to a certain temperature and/or for a certain duration to help burn off the particulate material on particulate filter 106 in after-treatment system 102.

A step 306 may include increasing the load on engine 100 during the regeneration procedure by upstroking implement pump 206, for example, via one or more components of hydraulic system 200. In this aspect, controller 30 may signal valve 204 to transition from a closed configuration to a more open configuration, for example, by delivering current to solenoid 230. As discussed above, this current through solenoid 230 may deliver more hydraulic fluid to implement pump 206, which in turn causes implement pump 206 to pump hydraulic fluid at a higher pressure. Implement pump 206 pumping the hydraulic fluid at the higher pressure may increase the load demand on engine 100, as engine 100 powers implement pump 206. The increased load demand on engine 100 may increase the temperature of the exhaust output by engine 100, which may help to burn off particulate matter on particulate filter 106 in after-treatment system 102. The hydraulic fluid pumped at the higher pressure by implement pump 206 is not used, for example, does not drive any components of implement valve subsystem 208. Instead, as discussed below, the pressurized fluid may be released through one or more valves and return to a hydraulic fluid tank or reservoir (not shown).

In one aspect, step 306 may be optional. For example, controller 30 may only signal valve 204 to transition to the more open configuration when the temperature at particulate filter 106 is below a certain threshold temperature. In this aspect, controller 30 may be coupled to a temperature sensor, for example, at an inlet of particulate filter 106. Alternatively or additionally, controller 30 may only signal valve 204 to transition to the more open configuration when the ambient temperature is below a certain threshold temperature. In this aspect, controller 30 may be coupled to a temperature sensor on a portion of wheel loader 10. Furthermore, controller 30 may be coupled to one or more of lift pressure sensor 24, tile pressure sensor 28, arm position sensor 32, and/or bucket position sensor 34. Controller 30 may receive one or more signals from these sensors indicative of a position and/or load of bucket 20, which may be indicative of a pressure demand on implement pump 206 and/or a power demand on engine 100. In this aspect, controller 30 may only signal valve 204 to transition to the more open configuration when one or more of the pressure demand on implement pump 206 and/or the power demand on engine 100 are below certain thresholds, for example, indicating low load conditions.

Then, a step 308 includes ending the regeneration procedure. If step 306 is performed, step 308 includes signaling valve 204 to transition to a more closed configuration, for example, by delivering a lower current (or no current) through solenoid 230.

Lastly, method 300 includes a step 310, in which wheel loader 10 returns to performing the operation (e.g., moving material). Step 310 may include indicating to the user that the regeneration procedure is complete. Nevertheless, it is noted that wheel loader 10 may also be operated during the regeneration procedure.

Method 300 may also include displaying one or more indications to a user, for example, via a user interface. For example, one or more the indications may indicate to the user that wheel loader 10 is undergoing a regeneration procedure, an estimated duration of the regeneration procedure, when the regeneration procedure is complete or nearing completion, etc.

Figure 4:
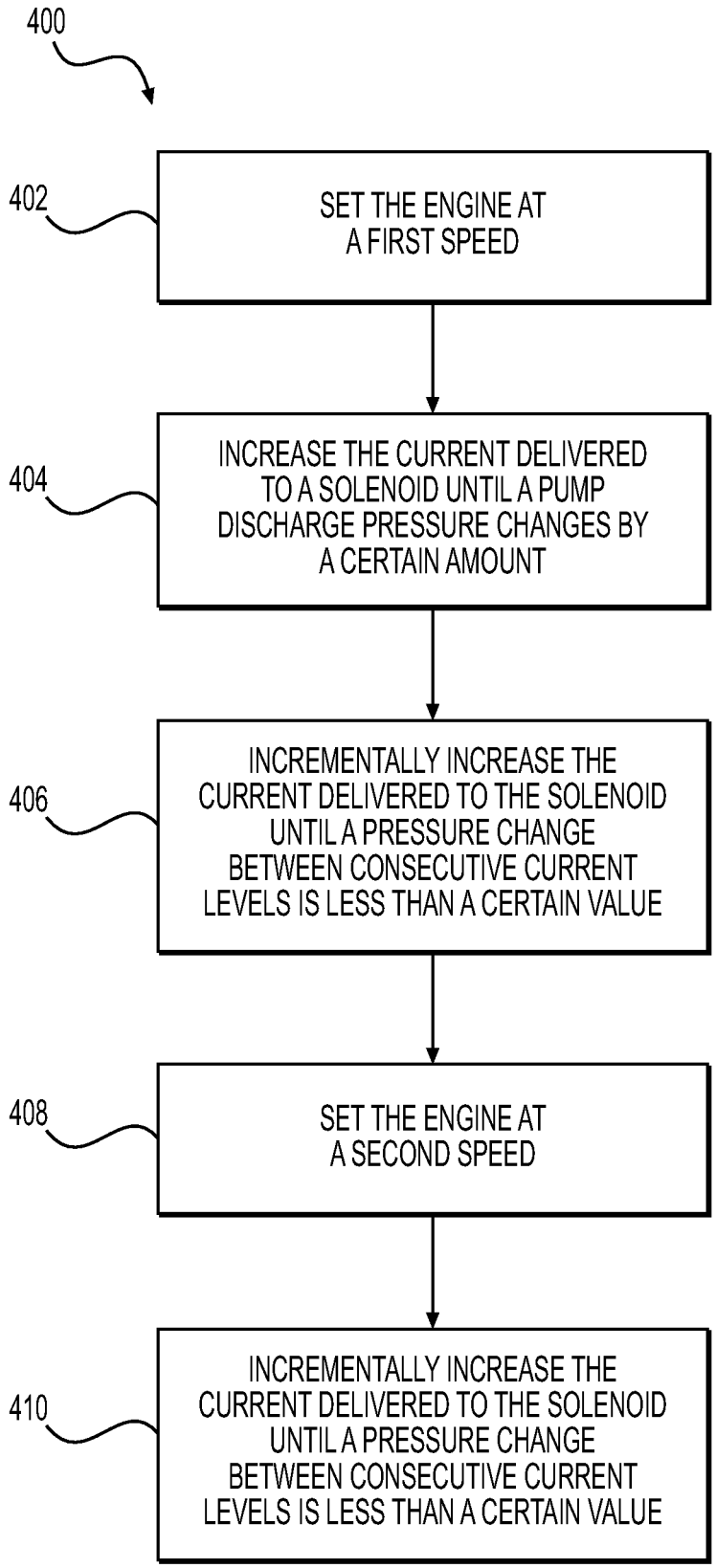
FIG. 4 provides a flow chart depicting an exemplary method for calibrating one or more aspects of the hydraulic system of the machine.
Figure 5:
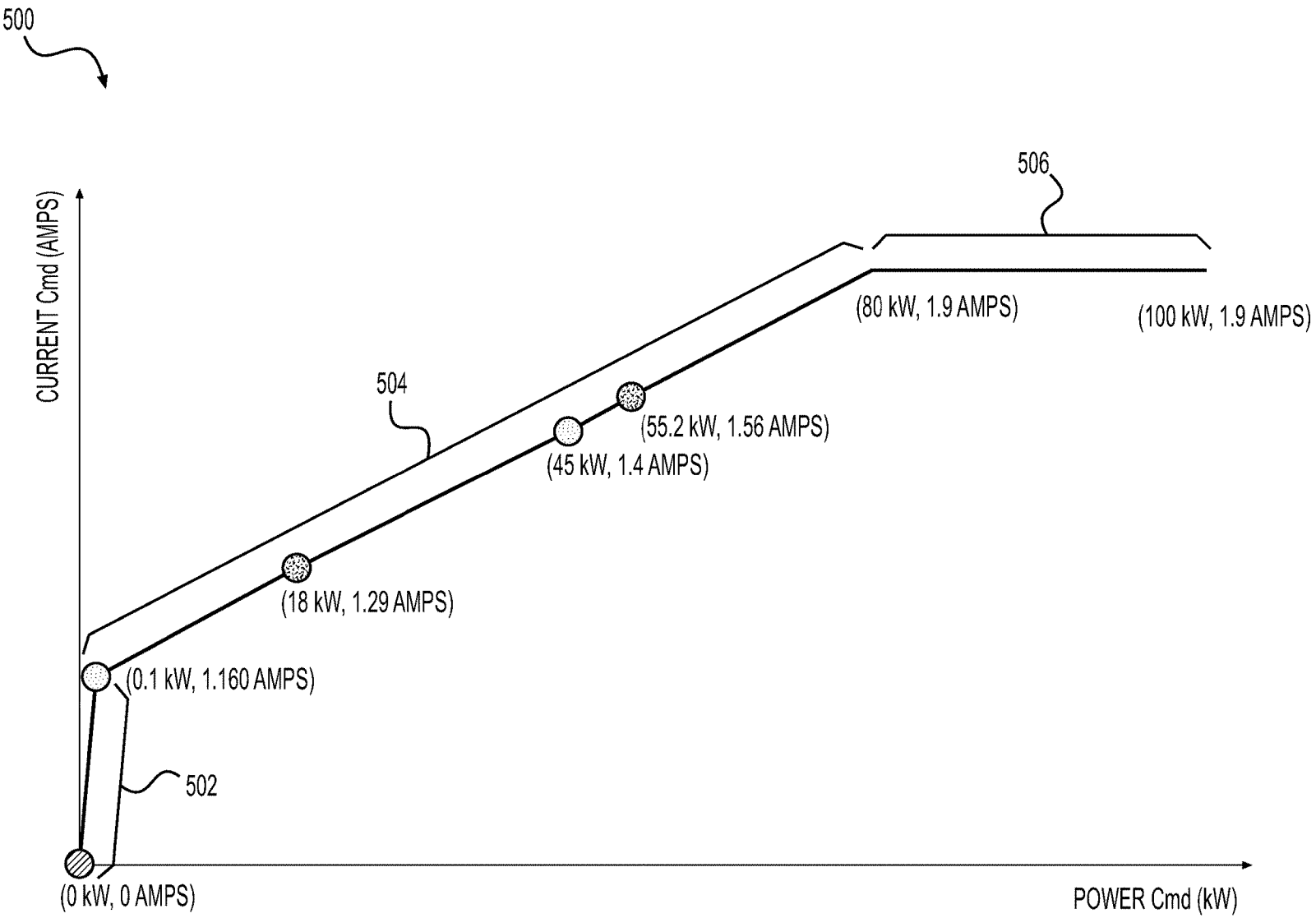
FIG. 5 illustrates a graph of the current command and the power command formed during the calibration of one or more aspects of the hydraulic system of the machine.

FIG. 4 is a flow chart depicting an exemplary method 400 for calibrating and/or mapping a relationship of components of hydraulic system 200. For example, method 400 is a method for calibrating and/or mapping a relationship of a signal or current to valve 204 relative to a pressure command on implement pump 206 and, correspondingly, a load command on engine 100. FIG. 5 is a graph of portions of the calibration during method 400.

Although not shown, method 400 may include an initial step of entering a calibration mode, for example, automatically and/or based on user input. The initial step of entering the calibration mode may be done after the manufacture of wheel loader 10 and during initial calibration of wheel loader 10, for example, before shipment to a user. Alternatively or additionally, the initial step of entering the calibration mode may be done while wheel loader 10 is at a work site. In some aspects, various aspects of method 400 may depend on the operational conditions of wheel loader 10 and/or surrounding wheel loader 10, for example, ambient temperatures, work site elevation, bucket load conditions, engine speeds, etc. A step 402 includes setting engine 100 at a first engine speed, for example, approximately 800 rotations per minute ("rpm"). A step 404 then includes increasing (or ramping up) the current delivered to solenoid 230, for example, to transition valve 204 to a more open position such that a greater amount of hydraulic fluid and/or a higher pressure of hydraulic fluid is delivered to implement pump 206. Step 404 may include increasing the current to solenoid 230 until a pump discharge pressure (e.g., as measured by pressure sensor 216) changes by a certain amount, for example, by approximately 100 kPa. The change in the pump discharge pressure may be indicative of the start of an active range for valve 204, which may be a proportional EH valve. Nevertheless, the change in the pump discharge pressure may not yet indicate the active range over which the current to solenoid controls the overall load add control on engine 100.

Method 400 further includes a step 406, in which the current to solenoid 230 is incrementally increased or ramped up. For example, the current to solenoid 230 may be increased by approximately 0.01 amps to approximately 0.02 amps, and may be held at each current level for a period of time, for example, approximately 5 seconds, approximately 10 seconds, approximately 20 seconds, approximately 30 seconds, etc. In one aspect, the current to solenoid 230 may be increased by approximately 5% to 10% of the previous current value. Each level of current to solenoid may yield a steady state pressure generated by the pump, which may be measured and recorded. The incremental increase in the current to solenoid 230 may be performed until the pressure change between consecutive current levels is less than a certain value (e.g., approximately 50 kPa). A pressure change between consecutive current levels being less than the certain value may be indicative of implement pump 206 reaching a maximum displacement. At the maximum displacement, the current command, the measured average pump pressure, and the actual engine speed may be recorded.

The current values and pressure values at the first engine speed may be correlated, for example, graphed, as discussed below with respect to FIG. 5. For example, the commanded current, actual average pump pressure while at the commanded current, and an actual average engine speed may all be recorded for each commanded current level to solenoid.

Then, the output power (or power command on engine 100) may be calculated, for example, using the engine speed and pump pressure. In one aspect, the calculation may assume a pump speed to engine speed ratio and a maximum pump displacement based on various system and/or design parameters. A pump flow may be calculated based on the pump speed times the maximum pump displacement. The pump flow for a given situation may be calculated based on the pressure of hydraulic fluid in discharge line 206*a*. For example:

$$\text{Pump Flow}=\text{Engine Speed}\times 1.0448\times\text{Maximum Pump Displacement}$$

The pump power may be calculated by the pump flow times the average pump pressure. In one example, the maximum pump power may equal the pump displacement of 165 cc/revolution times the average pump pressure of 8,000 kPa. Accordingly, if the engine speed is 800 rpm, the output engine power may calculated to be approximately 18 kW. It is noted that this calculation includes multiplying by $1.667\times 10^{-8}$ in order to convert to kilowatts. Alternatively, although not shown, instead of calculating pump power by multiplying the flow and pressure, the pump power may calculated by multiplying the torque and the shaft speed.

Next, method 400 includes a step 408, in which engine 100 is set to a second engine speed, for example, approximately 1800 rpm. Then, step 406 may be repeated at the second engine speed as a step 410. For example, the current to solenoid 230 may be increased until a pump discharge pressure changes by a certain amount, for example, approximately 100 kPa. The change in the pump discharge pressure may be indicative of the start of an active range for valve 204, which may be a proportional EH valve. Additionally, the current to solenoid 230 may then be incrementally increased or ramped up, and the pump discharge pressure at each level of current to solenoid 230 may yield a steady state pressure generated by the pump, which may be measured and recorded. Again, the maximum pump flow at the second engine speed may be calculated, and then the engine power may be calculated at the second engine speed.

As shown in FIG. 5, the measurements made during of method 400 may be graphed as a current to power calibration curve. For example, the two sets of solenoid current commands and the calculated engine power commands (at the two different engine speeds) may be plotted on a graph (FIG. 5), and method 400 may extrapolate a line between the two points to create a current to power calibration curve. The current to power calibration curve may be used to correlate a current through solenoid 230 with a power command on engine 100, and thus a resulting temperature of the exhaust from engine 100, which may help burn off particulate material on particulate filter 106. It is noted that the measurements of method 400 and graph of FIG. 5 assumes a substantially linear relationship between the power of implement pump 206 and the current through solenoid 230. If other or additional components are used, this relationship may not be substantially linear. In this instance, the steps of method 400 may be repeated, for example, in order to obtain additional data points (e.g., third and fourth data points). The data points on the graph of the current through solenoid 230 and the power of implement pump 206 may then be used to determine the relationship. In this aspect, method 400 may be repeated as many times as necessary to obtain data points and determine the relationship between the current through solenoid 230 and the power of implement pump 206.

FIG. 5 illustrates a graph 500 of an exemplary relationship between the current command (e.g., in amps ("A")) delivered to solenoid 230 and the power command (i.e., in kilowatts ("kW")) output by engine 100, for example, in order to power implement pump 206. The power command may be an additional power command relative to a baseline power command on engine 100, for example, under idling conditions. As shown, with 0 A delivered to solenoid 230, engine 100 outputs a power command of 0 kW. As the current is increased, for example, to approximately 1.160 A, the power command increases, for example, to approximately 0.1 kW. This initial increase in power command relative to the increased current command may include a steep slope, as shown by a portion 502.

As discussed above, portion 502 may correspond to step 404. Then, as the current is further increased, the increase in power command relative to the increased current command may include a slope that is less steep, as shown by portion 504. Over portion 504, at a first engine speed (e.g., 800 rpm), the current command may be increased from approximately 1.160 A to approximately 1.4 A, and the power command on engine 100 may be calculated based on the engine speed and the pressure of hydraulic fluid from implement pump 206. In this aspect, the power command on engine 100 may be approximately 45 kW. Then, the current command to solenoid 230 may be increased to approximately 1.9 A, and the resulting power command on engine 100 may be approximately 80 kW. However, further increasing the current command may not significantly increase the current through solenoid 230, and minimally increase the power command, for example, corresponding to the maximum pump flow. For example, as shown in FIG. 5, the current command may remain at approximately 1.9 A, and the power command may be approximately 100 kW. This may be indicative of saturation of the current command at a configurable maximum current value, for example, as shown by portion 506 of graph 500. Alternatively or additionally, this may be indicative that implement pump 206 has reached maximum displacement, and thus that no additional power can be achieved. Furthermore, this may be indicative that the control valve output pressure has saturated or at a maximum value. As discussed above, portions 504 and 506 may correspond to step 406.

Engine 100 may then be set to a second engine speed, for example, a maximum engine speed and/or approximately 1800 rpm, corresponding to step 408. Then, step 404 may be repeated, for example, as step 410, and the current delivered to solenoid 230 may be incrementally increased until a pressure change between consecutive current values is less than a certain value. For example, step 410 may include setting the current command at approximately 1.29 A and measuring an engine command of approximately 18 kW. Moreover, setting the current command at approximately 1.56 A may result in a measured engine command of approximately 55.2 kW. These measurements may also be plotted in graph 500. For example, as shown in FIG. 5, portion 504 may be substantially linear, illustrating the relationship between the current applied to solenoid 230 and the power command on engine 100 over this active range, corresponding to step 406 of method 400. Additionally, graph 500 may be used to extrapolate a resulting power command on engine 100 for one or more current commands for solenoid 230, which may also be used to increase the load on engine 100, for example, to help burn off particulate material on particulate filter 106, to help in general retarding (e.g., when wheel loader 10 is traveling down a hill), to help warm up engine 100 or other components of wheel loader 10, for example, when starting wheel loader 10 in cold ambient temperatures, etc. Although the above current commands and power commands are discussed as a part of graph 500, it is noted that additional data points may be used to form graph 500 or otherwise extrapolate a relationship of the current command and resulting power command under additional conditions, for different engine speeds, etc. Then, the calibrated relationship between the current commands and the power commands may be used, for example, in method 300, to help perform a regeneration procedure. Additionally, as mentioned above, one or more steps of method 400 may be repeated in order to obtain additional measurements of the pressure changes between different current values, for example, in order to more accurately determine a correlation between the current through solenoid 230 and the power of implement pump 206.

Moreover, although not shown, method 400 may be performed, and graph 500 may be formed, in a reverse order. For example, for a first engine speed, a maximum current command may be applied to saturate solenoid 230 with the maximum current, and the actual pump power may be calculated, indicative of portion 506 as discussed above. Then, the current command may be incrementally reduced until the pump pressure decreases by a certain amount. The current command may be reduced further, and the actual pump power may be determined and plotted, as discussed above to form portion 504. Lastly, the current command may be reduced further (closer to 0 A), until the pump pressure decreases significantly, indicative of portion 502. Then, these steps may be repeated at a second engine speed. In some instances, the pump pressure decrease may be observed after engine 100 has been set to the second engine speed. The current commands on solenoid and resulting actual pump power on engine 100 may be graphed to form a graph similar to graph 500.

INDUSTRIAL APPLICABILITY

The disclosed aspects of hydraulic system 200 of the present disclosure may be used in any wheel loader 10 or other machine having one or more hydraulic systems. Valve 204 may be incorporated into hydraulic system 200 with minimal modifications of existing hydraulic systems. Moreover, the delivery of hydraulic fluid from valve 204 to implement pump 206 causes implement pump 206 to upstroke without a pressure demand from implement valve subsystem 208. Accordingly, the regeneration command, via implement pump 206, may require an increased load command on engine 100 (e.g., increasing the temperature of the exhaust from engine 100 to increase the temperature at particulate filter 106) without an implement command.

As discussed above, valve 204 may be an electrohydraulic valve with solenoid 230. Using valve 204 to deliver hydraulic fluid to implement pump 206, for example, by applying current through solenoid 230, may cause implement pump 206 to upstroke and demand greater power from engine 100, even though implement pump 206 or implement valve 208 are not otherwise requesting greater power from engine 100. Additional components of hydraulic system 200, for example, margin relief valve 214, help to release or dump hydraulic fluid from hydraulic system 200, which may help to reduce the overall pressure, generate a flow restriction for hydraulic fluid, and/or increase the pressure on implement pump 206 and the power demand on engine 100, without inadvertently delivering high pressure hydraulic fluid to implement valve subsystem 208 or individual subsystems 208*a*-208*c*. The pressure demand on implement pump 206, and thus the power demand on engine 100, may be proportional to the current applied through solenoid 230 of valve 204. Moreover, the increase power demand on engine 100 may increase the temperature of exhaust from engine 100, which may help perform or expedite a regeneration cycle to burn off or otherwise remove particulate material on particulate filter 106 of after-treatment system 102, for example, when wheel loader 10 is in cold ambient temperature conditions and/or there is a low load on engine 100. Additionally, it is noted that the strategy to increase the power demand on engine 100 discussed herein may also be used in other circumstances. For instance, the strategy to increase the power demand on engine 100 may be used for general retarding, for example, while wheel loader 10 is traversing a steep down grade and additional load on engine 100 is required. Furthermore, the strategy to increase the power demand on engine 100 may be used to help warm up engine 100 and/or other elements (e.g., hydraulic system 200) of wheel loader 10, for example, when starting wheel loader 10 in cold ambient temperature conditions.

Furthermore, the calibration methods discussed herein may allow for a user and/or controller 30 to extrapolate a relationship between current commands on solenoid 230 and the resulting power command on engine 100. For example, as discussed above, within a determined range (i.e., portion 504), increasing the current through solenoid 230 increases the flow of hydraulic fluid to implement pump 206, which proportionally increases a pressure demand on implement pump 206, creating a proportional power command on engine 100. As a result, the temperature of exhaust output from engine 100 may be increased without otherwise moving other components of wheel loader 10. Moreover, this procedure may be performed by controller 30, thus reducing or eliminating a need for user intervention during a regeneration cycle. For example, controller 30 may determine the range of portion 504. Controller 30 may then selectively deliver current through solenoid 230 during a regeneration cycle to control the output pressure of implement pump 206, and thus control the load demand on engine 100 and increase the temperature of exhaust output from engine 100 during the regeneration cycle, for example, when wheel loader 10 is in cold ambient temperature conditions and/or there is a low load on engine 100. Based on the calibration, controller 30 may deliver an appropriate or necessary amount of current to solenoid 230 to increase the power command on engine 100 as appropriate or needed, for example, in order to increase the temperature of the exhaust from engine 100 and correspondingly increase the temperature at particulate filter 106. As mentioned, controller 30 may be coupled to one or more temperature sensors, along with lift pressure sensor 24, tilt pressure sensor 28, arm position sensor 32, bucket position sensor 34, etc., and may thus determine when temperature and/or load conditions necessitate performing method 300 during a regeneration cycle.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. For example, hydraulic system 200, method 300, and method 400 may be used on any machine having integrated hydraulic systems. It is intended that the specification and examples be considered as exemplary only, with a true scope and spirit of the invention being indicated by the following claims.

What is claimed is:

1. A hydraulic system for a machine, comprising:

an implement pump, wherein the implement pump includes a load sensing control;

a valve that controls the flow of hydraulic fluid to the implement pump, wherein the valve is an electrohydraulic proportional relief valve comprising a solenoid configured to adjust the pressure of hydraulic fluid delivered to the implement pump proportionally to a current delivered through the solenoid;

an implement valve subsystem including one or more implement control subsystems to control movement of an implement; and a controller configured to:

receive a signal indicative of a regeneration cycle;

control the current delivered to the electrohydraulic proportional relief valve to control the flow of hydraulic fluid to the implement pump;

receive one or more signals indicative of ambient temperature, a temperature within a portion of an after-treatment system, and/or a load on the engine; and send a signal to increase the current to the solenoid to open the electrohydraulic proportional relief valve to deliver hydraulic fluid to the implement pump to upstroke the implement pump when one or more of the signals indicative of ambient temperature, temperature within a portion of the after-treatment system, and/or load on the engine is below a threshold value.

2. The system of claim 1, wherein the implement pump is configured to be powered by an engine of the machine.

3. The system of claim 2, wherein the delivery of hydraulic fluid from the electrohydraulic proportional relief valve to the implement pump causes the implement pump to upstroke without a pressure demand from the implement valve subsystem.

4. The system of claim 3, further comprising a resolver and a relief valve, wherein the resolver is positioned between the electrohydraulic proportional relief valve and the implement pump, and wherein the relief valve is coupled to the discharge line of the implement pump between the implement pump and the electrohydraulic proportional relief valve.

5. The system of claim 4, wherein the machine is a wheel loader, and wherein the implement is a bucket.

6. A method of operating a hydraulic system for a machine, the method comprising:

in response to a regeneration cycle for a particulate filter in an after-treatment system for an engine, detecting one or more of an ambient temperature, a temperature of the exhaust of the engine, or a load demand on the engine; and in response to one or more of the ambient temperature, the temperature of the exhaust of the engine, or the load demand on the engine being below respective threshold values, delivering current through a solenoid of an electrohydraulic valve, wherein the electrohydraulic valve controls a flow of hydraulic fluid to an implement pump, and wherein the current through the solenoid causes the electrohydraulic valve to open and deliver hydraulic fluid to the implement pump to upstroke the implement pump, wherein the implement pump controls an implement and includes a load sensing control configured to increase the pressure demand on the implement pump in response to the delivery of hydraulic fluid, and wherein the increase pressure demand on the implement pump is configured to increase the power demand on the engine.

7. The method of claim 6, wherein the increased pressure demand on the implement pump causes the implement pump to upstroke without a pressure demand from the implement valve subsystem.

8. The method of claim 7, further comprising:

an initial step of calibrating a relationship between the current through the solenoid of the valve and the power demand on the engine.

9. The method of claim 8, wherein the step of calibrating the relationship between the current through the solenoid of the valve and the power demand on the engine includes:

setting the engine at a first speed;

increasing the current delivered to the solenoid until a pump discharge pressure changes by a certain amount; and incrementally increasing the current delivered to the solenoid until the pressure change between consecutive current levels is less than a certain value.

10. The method of claim 9, further comprising:

setting the engine at a second speed;

increasing the current delivered to the solenoid until the pump discharge pressure changes by the certain amount; and incrementally increasing the current delivered to the solenoid until the pressure change between consecutive current levels is less than the certain value.

11. The method of claim 10, further comprising determining a proportional relationship between the current delivered to the solenoid and the resulting power demand on the engine at the first and second speeds of the engine.

12. The method of claim 11, wherein the machine is a wheel loader, and wherein the implement is a bucket.

13. An earthmoving machine, comprising:

an engine;

an implement; and a hydraulic system, wherein the hydraulic system includes:

an implement pump, wherein the implement pump is powered by the engine and is configured to drive the implement, and wherein the implement pump includes a load sensing control; and an electrohydraulic valve that controls the flow of hydraulic fluid to the load sensing control of the implement pump, wherein the electrohydraulic valve comprises a solenoid configured to adjust the pressure of hydraulic fluid through the electrohydraulic valve proportionally to a current delivered through the solenoid and a controller configured to:

receive a signal indicative of a regeneration cycle;

control the current delivered to the electrohydraulic proportional relief valve to control the flow of hydraulic fluid to the implement pump;

receive one or more signals indicative of ambient temperature, a temperature within a portion of an after-treatment system, and/or a load on the engine, and send a signal to increase the current to the solenoid to open the electrohydraulic proportional relief valve to deliver hydraulic fluid to the implement pump to upstroke the implement pump when one or more of the signals indicative of ambient temperature, temperature within a portion of the after-treatment system, and/or load on the engine is below a threshold value.

14. The earthmoving machine of claim 13, wherein the hydraulic system further includes an implement valve subsystem for controlling portions of the implement, wherein the delivery of hydraulic fluid from the electrohydraulic valve to the implement pump causes the implement pump to upstroke without a pressure demand from the implement valve subsystem.

15. The earthmoving machine of claim 14, wherein the machine is a wheel loader, and wherein the implement is a bucket.

16. The earthmoving machine of claim 15, wherein the hydraulic system further includes the implement valve subsystem controlling portions of a bucket, and wherein the implement valve subsystem includes a rack/dump control subsystem, a lift/lower/float control subsystem, and an auxiliary control subsystem.

* * * * *